United States Patent [19]

Knohl

[11] 4,015,448

[45] Apr. 5, 1977

[54] SUPPORT STOCKING

[75] Inventor: Herbert Knohl, Seneca, S.C.

[73] Assignee: Colgate-Palmolive Company, New York, N.Y.

[22] Filed: Jan. 8, 1975

[21] Appl. No.: 539,350

Related U.S. Application Data

[63] Continuation-in-part of Ser. No. 426,318, Dec. 19, 1973, abandoned.

[52] U.S. Cl. ..... 66/185; 66/178 A; 66/187

[51] Int. Cl.[2] ..... D04B 9/52; D04B 9/56

[58] Field of Search ..... 66/178 A, 185, 186, 66/187, 190

[56] References Cited

UNITED STATES PATENTS

| | | | |
|---|---|---|---|
| 2,357,630 | 9/1944 | Cole | 66/185 |
| 2,980,981 | 4/1961 | Reymes-Cole et al. | 66/185 |
| 3,125,848 | 3/1964 | Baebler | 66/178 A X |
| 3,187,522 | 6/1965 | Knohl | 66/186 |
| 3,210,964 | 10/1965 | Russell | 66/178 A |
| 3,241,340 | 3/1966 | Knohl | 66/185 |
| 3,310,962 | 3/1967 | Mahler et al. | 66/187 X |
| 3,327,500 | 6/1967 | Currier | 66/187 |
| 3,425,246 | 2/1969 | Knohl | 66/178 A X |
| 3,443,404 | 5/1969 | Knohl | 66/178 A |
| 3,453,843 | 7/1969 | Knohl et al. | 66/185 |
| 3,546,900 | 12/1970 | Knohl | 66/185 |
| 3,603,116 | 9/1971 | Turini | 66/187 |
| 3,800,563 | 4/1974 | Billi | 66/187 X |
| 3,905,212 | 9/1975 | Bounous et al. | 66/185 |

FOREIGN PATENTS OR APPLICATIONS

| | | | |
|---|---|---|---|
| 284,301 | 1/1929 | United Kingdom | 66/187 |
| 669,300 | 4/1952 | United Kingdom | 66/185 |
| 1,107,712 | 3/1968 | United Kingdom | 66/187 |
| 1,264,951 | 2/1972 | United Kingdom | 66/187 |

OTHER PUBLICATIONS

Peel, *Knitting Times*, No. 1, 1971, vol. 40, No. 45, pp. 37, 38.

*Primary Examiner*—Mervin Stein
*Assistant Examiner*—A. M. Falik

[57] ABSTRACT

A tubular knit seamless stocking having boot, heel, instep and toe portions formed of non-elastomeric yarn, incorporating, substantially throughout except in the toe portion, at least one elastomeric stretchable retractive yarn having the major portion thereof inlaid coursewise of, and locked in, said portions. The toe portion is formed primarily of non-elastomeric yarn and is free from elastomeric stretchable retractive yarn. The non-elastomeric yarn may be stretch or torque yarn preferably of *s* and *z* twist in the boot, heel and instep portions. The heel and toe portions each include a shaped pocket knit of non-elastomeric yarn including partial courses preferably varying in length in the toe portion, the cut ends of yarn of each partial course being knit in tuck-float relationship with a stitch loop of an adjacent course to prevent pulling out. The toe portion further includes a toe inspection opening including a welt of doubled stretchable elastic fabric incorporating elastomeric stretchable retractive yarn and having transferred stitches providing the doubled fabric welt. It may have a run resistant tab portion extending beyond the transferred stitches.

7 Claims, 12 Drawing Figures

FIG 4
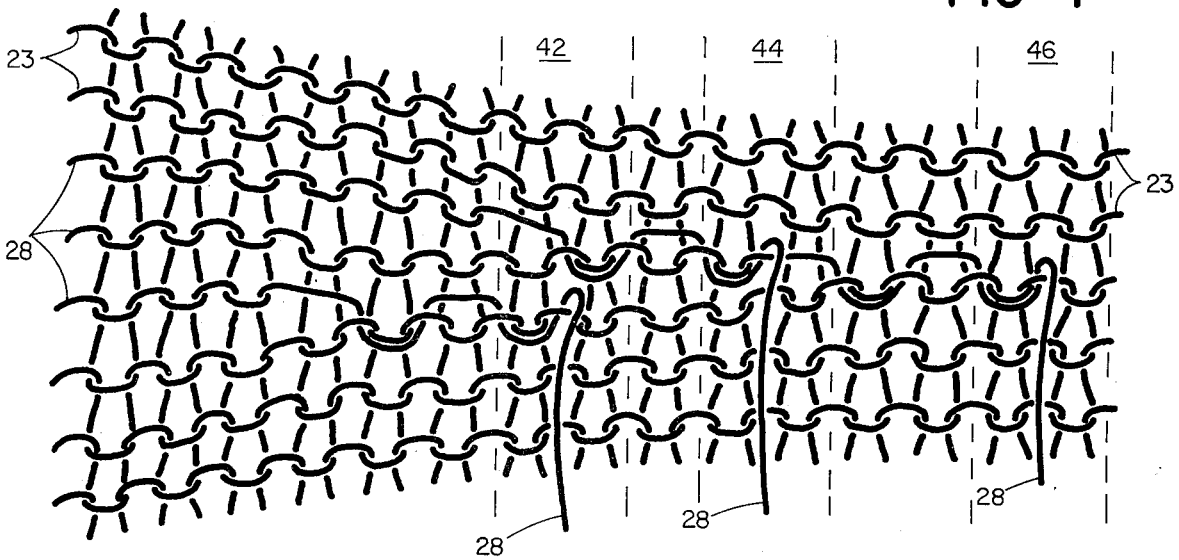
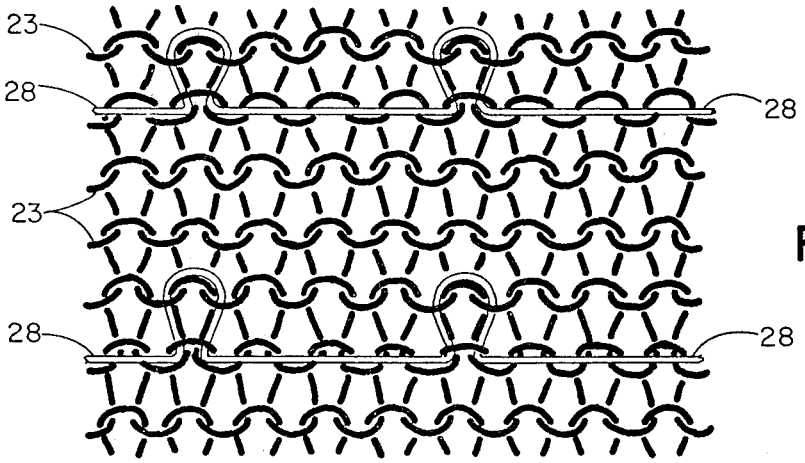
FIG 5
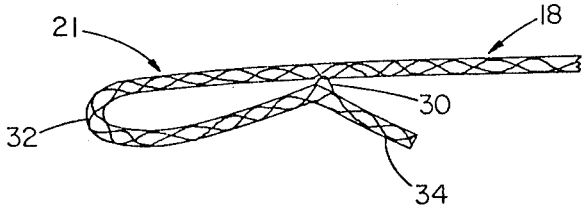
FIG 6

SUPPORT STOCKING

CROSS-REFERENCE TO RELATED APPLICATIONS

This invention is a continuation-in-part of my application, Ser. No. 426,318 filed Dec. 19, 1973, now abandoned.

The inventions of this application are somewhat related to those set forth in:

U.S. Pat. No. 3,546,900 issued Dec. 15, 1970;
U.S. Pat. No. 3,461,695 issued Aug. 19, 1969;
U.S. Pat. No. 3,453,843 issued July 8, 1969;
U.S. Pat. No. 3,443,404 issued May 13, 1969;
U.S. Pat. No. 3,425,246 issued Feb. 4, 1969;
U.S. Pat. No. 3,241,340 issued Mar. 22, 1966;
U.S. Pat. No. 3,187,522 issued June 8, 1965; and
U.S. Pat. No. Re25,046 issued Oct. 3, 1961.

BACKGROUND OF THE INVENTION

This invention is concerned with tubular knitted therapeutic stockings and more particularly to the foot construction thereof.

The foot construction of therapeutic stockings is beset with a number of problems arising, for example, from the necessity of maintaining the stocking in position, while achieving comfortable fit and the desired pressure distribution, and usually of providing an inspection toe opening as well, and of doing this at reasonable cost.

Therapeutic stockings knitted on machines with reciprocating cylinders usually contain non-elastic heel and toe pockets. The knitting of these heel and toe pockets is very time consuming and therefore more costly. Multifeed tube type hosiery machines are more efficient and less costly to operate but they are not constructed to provide reciprocated heel and toe pockets. It is therefore necessary to devise other means to produce shaped, form-fitting heel and toe pockets.

SUMMARY OF THE INVENTION

It is a major object of this invention to provide a therapeutic stocking having a novel foot construction which satisfies all of the desired criteria and to do so more efficiently.

It is another object of this invention to provide such a stocking with an inspection toe construction which is knitted on a tube type hosiery machine completely finished and which requires no additional hand work other than the usual scouring and boarding operations. The inspection toe pocket can be provided on the top or the bottom of the toe region. A stocking of this type is particularly adaptable for use by hospital patients especially when it is constructed to contain elastomeric yarn to provide the carefully adjusted support function recommended by the medical profession.

Another object of this invention is the provision of form-fitting heel pockets including partial courses with special stitch combinations in the margin areas of the partial courses.

Still another object of the invention is to provide for the formation of a truly form-fitting inspection toe pocket consisting of partial courses with special stitch combinations in the marginal areas of the partial courses. All of these special features are provided through the utilization of varying stitch densities and by supplying different amounts of elastomeric and non-elastomeric stretch yarn throughout the stocking or other leg and foot garment to provide the desired amount of support in each particular leg and foot section.

Therapeutic stockings of this invention provide specific amounts of compression on the human leg when worn by patients. This compression is produced by combining the specific stitch density in each stocking section with specific amounts of non-elastomeric stretch yarn with elastomeric inlay yarn. It differs in the upper thigh, lower thigh, knee, calf, ankle, the graduated instep, and the foot portions.

The above and still further objects of the invention are accomplished by providing a tubular knit seamless stocking foot construction in a stocking having a boot portion, a heel portion, an instep portion and a toe portion.

In one aspect of the invention, the boot, instep and heel portions may be formed primarily of fine stretch non-elastomeric torque yarn of *s* and *z* twist alternately knitted in every course of said portion and incorporating substantially throughout said boot and instep portions at least one elastomeric substantially relaxed stretchable retractive stretch yarn defining the relaxed shape of said boot, heel and instep portions and having the major portion thereof inlaid coursewise of, and locked in, said knitted boot, heel and instep portions at frequent intervals in every course in which it occurs. The heel portion includes a shaped heel pocket which may be knit of said non-elastomeric yarn including partial courses varying in length, the yarn of each partial course being cut at opposite ends, and in which the yarn of each partial course may be knit in tuck-float relationship with at least one stitch loop of an immediately adjacent course to prevent pulling out of the cut ends of yarn. The toe portion may be formed primarily of fine stretch non-elastomeric doubled yarn and is free from elastomeric stretchable retractive yarn. The toe portion may also include a shaped toe pocket knit of said non-elastomeric yarn including partial courses varying in length to provide a shaped, tapered toe pocket, the yarn in each partial course being cut at opposite ends, and in which the yarn of each partial course may be knit in tuck-float relationship with at least one stitch loop of an immediately adjacent course to prevent pulling out of the cut ends of yarn.

In another aspect of the invention, the toe portion may include a toe inspection opening adjacent said shaped toe pocket, said toe inspection opening including a welt of doubled stretchable elastic fabric incorporating elastomeric stretchable retractive yarn, at least one course of said welt having transferred stitches providing said doubled fabric welt, and preferably having a run resistant tab portion extending beyond said transferred stitches.

For the purpose of fully describing the invention, reference is now made to the following detailed description of a preferred embodiment thereof, together with the accompanying drawings.

BRIEF DESCRIPTION OF THE DRAWINGS

FIG. 4 illustrates the fabric structure used in the toe portion, except the inspection opening portion thereof, of the stocking of FIG. 1;

FIG. 5 illustrates the fabric structure used in the toe inspection opening portion of the stocking of FIG. 1;

FIG. 6 is a sectional detail view of a portion of the stocking of FIG. 1; and

DESCRIPTION OF THE PREFERRED EMBODIMENT

Figure 1:
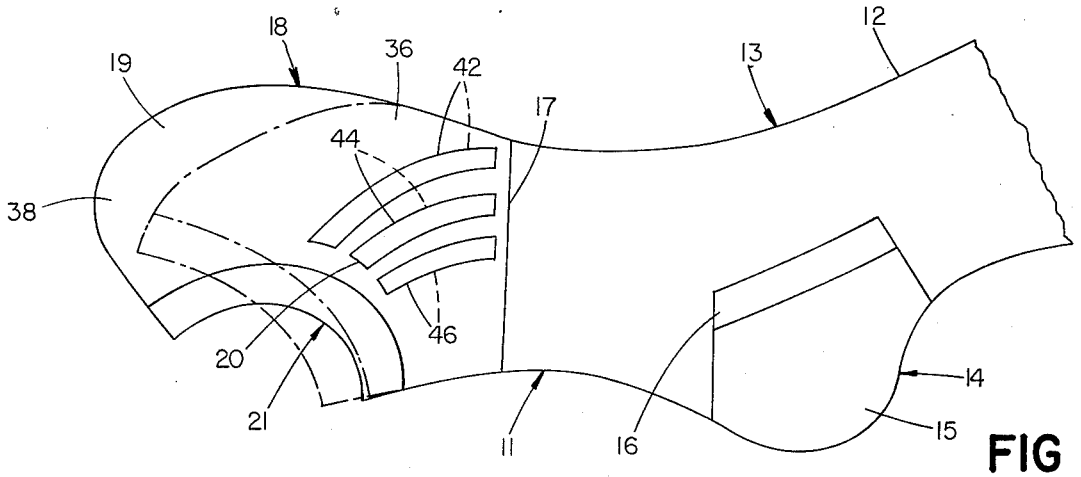
FIG. 1 is a diagrammatic side view of a therapeutic stocking having incorporated therein the foot construction of the invention.

Referring first to FIG. 1, the tubular knit seamless therapeutic stocking of the invention, as shown after boarding in solid lines and before boarding in phantom lines, generally includes a boot and foot portion 12 and 11, a heel portion 14, a stitch graduated instep portion 13 and a toe portion 18.

In accordance with the invention, certain of these portions are of differing constructions in order to produce different characteristics as desired.

Figure 2:
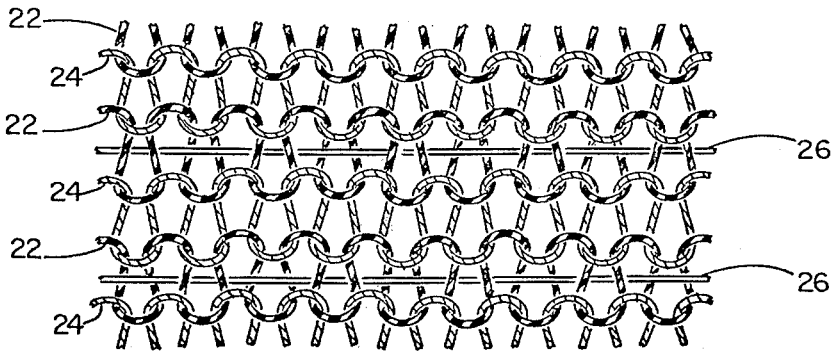
FIG. 2 illustrates the fabric structure used in the boot and foot portions of the stocking of FIG. 1.

To this end, as shown in FIG. 2, boot and foot portion 11 and 12 and stitch graduated instep portion 13 are formed primarily of fine non-elastomeric multi-filament stretch or torque yarn, of *s* twist 22 and *z* twist 24, alternately knitted in every course of said portion.

The non-elastomeric stretch yarns utilized in the stocking of the invention should be in the range of 50 to 100 denier, possibly with lower values in the toe portion, with about 13 to 26 filaments in each yarn, providing a range of about 2.5 to 5.5 denier per filament. They should have a high crimp contraction that is, the percent shrinkage which occurs upon heating, of at least about 46 percent to as high a value as can be effectively handled in the knitting machine, commonly about 60 to 70 percent. As a specific example, 70/1 nylon torque yarn with 17 filaments, providing a denier per filament of 4.1 and having a crimp contraction of about 58 percent may be utilized as the multi-filament non-elastomeric stretch yarn in the boot, heel and instep portions.

In order to provide the desired high retractive force, there is also incorporated, substantially throughout the boot, heel and instep portions, elastomeric stretchable and retractive yarn 26, in the range of 210 to 390 denier, herein specifically 280 denier nylon covered spandex, defining the relaxed shape of said boot, heel and instep portions and having the major portion thereof inlaid coursewise of, and, interlaced to lock in, said knitted boot and instep portions at frequent intervals in every course in which it occurs. The stretchable and retractive yarn 26 is provided in sufficient courses of the said boot and instep portions, herein shown as in every two courses, so that when said portions are in a stretched condition around the corresponding part of the human form of different diameters, it exerts the desired compressive force.

Elasticized, shaped or form-fitted heel and toe pockets consisting of extra partial courses are particularly useful in stockings of tubular construction such as hospital, surgical, and support stockings. A typical example of a heel structure is shown in U.S. Pat. No. 3,241,340. The flexing and stretching of these garments in actual use makes the trimmed ends of the necessary partial courses of stretch yarn particularly vulnerable to withdrawal from the last knitted stitches, resulting in runs in the margin area of the heel and toe pockets. It is advisable, therefore, to provide several safety stitches at the terminal points of the partial courses to prevent these runs. This can be accomplished by knitting several tuck stitches or combinations of tuck and float stitches at the terminal points of the partial courses of heel and toe pockets. Typical examples are shown in U.S. Pat. Nos. 3,603,116 and 3,181,314. The terminal points of the partial courses can be arranged to occur in a straight line or in a contoured manner depending mainly on the type of needle controls built into the hosiery machine used.

Figure 3:
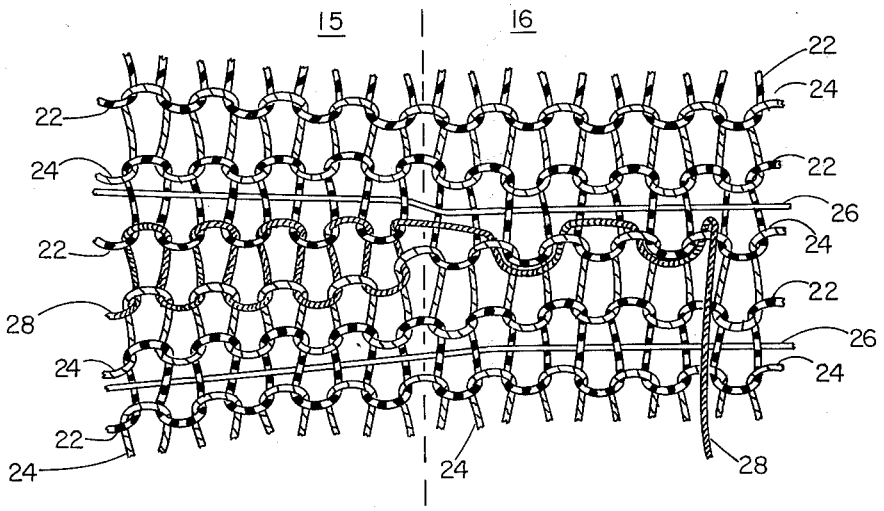
FIG. 3 illustrates the fabric structure used in the heel portion of the stocking of FIG. 1.
Figure 7A:
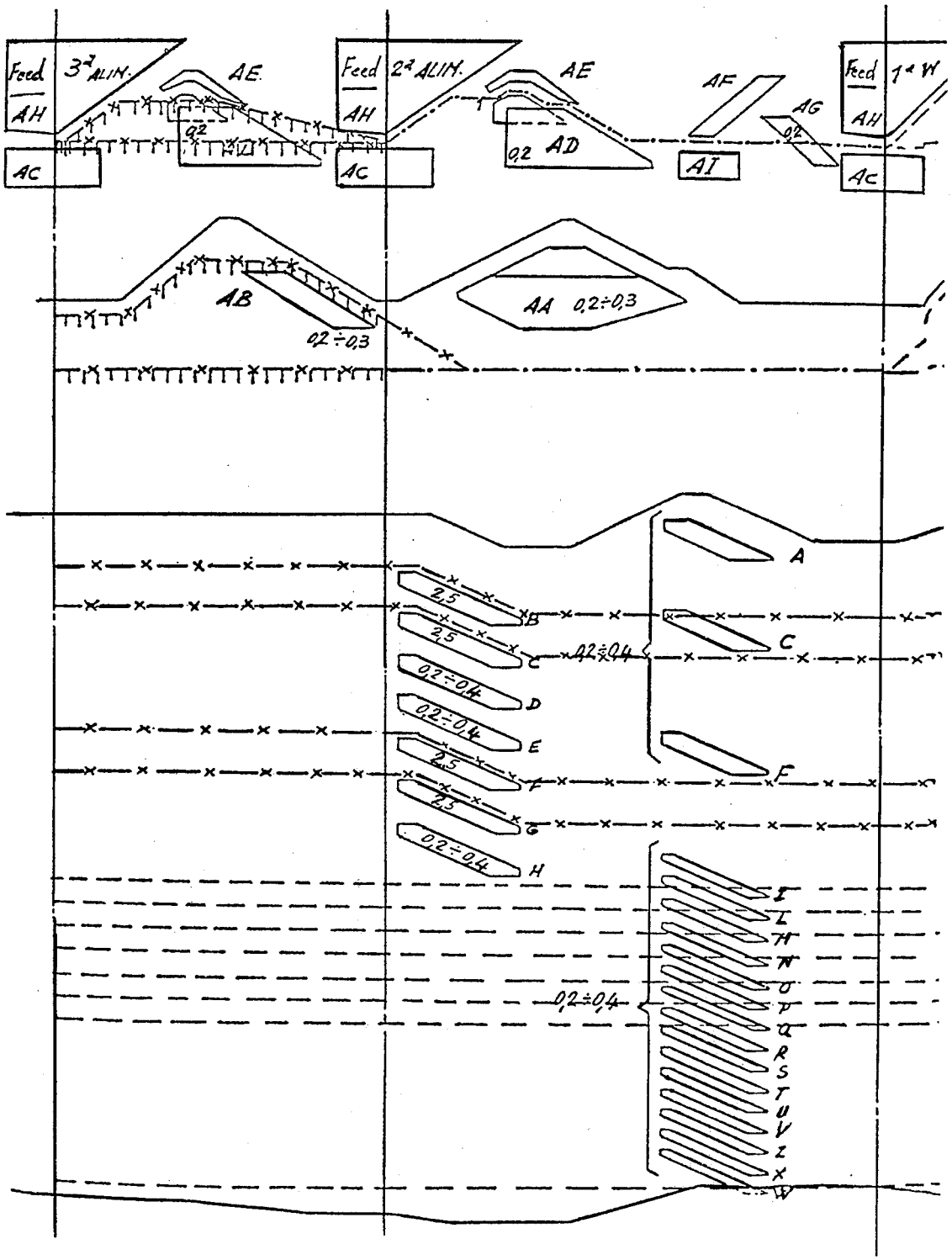
FIGS. 7*a* and *b*, 8*a* and *b* and 9*a* and *b* illustrate cam ring layouts for manufacturing the stocking of FIG. 1.
Figure 7B:
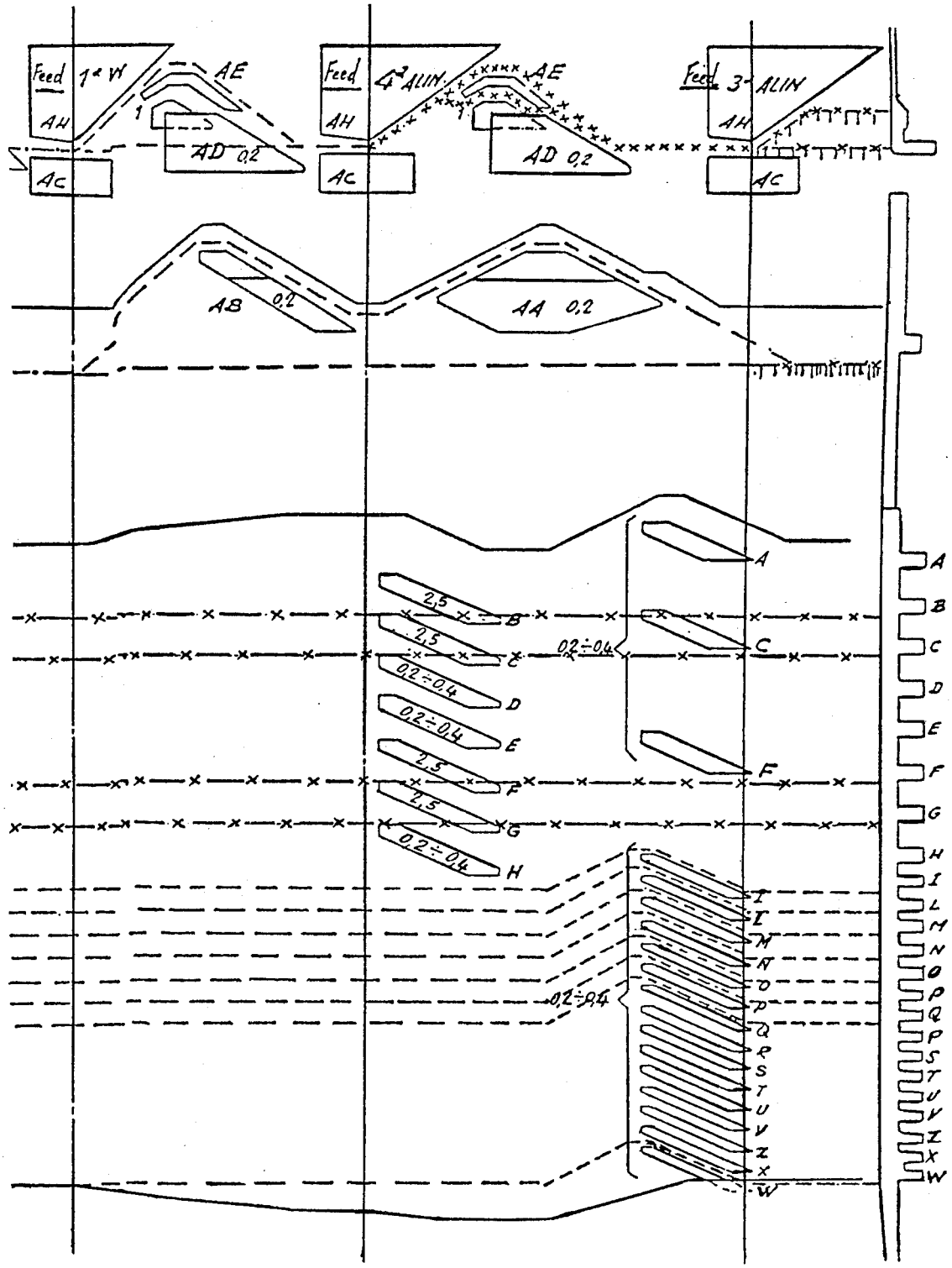

As shown in FIG. 3, heel portion 14 is also formed primarily of fine stretch torque yarn, of *s* twist 22 and *z* twist 24 alternately knitted in every course of said portion. It also incorporates, substantially throughout heel portion 14, elastomeric stretchable and retractive yarn 26, such as 280 denier nylon-covered spandex, defining the relaxed shape of said heel portion and having the major portion thereof inlaid coursewise of and interlaced to lock in said knitted heel portion at frequent intervals in every course in which it occurs. The stretchable and retractive yarn is again provided in sufficient courses, herein shown as in every two courses, so that when heel portion 14 is in a stretched condition around the heel, it exerts the desired compressive force.

Heel portion 14 includes a shaped heel pocket 15 which, in addition to non-elastomeric, stretch nylon yarns 22 and 24 and elastomeric yarns 26, is knit of fine non-elastomeric stretch 70/2 doubled (140 denier) nylon superloft yarn 28 in partial courses varying in length in area 15, as shown in FIG. 1, this heavier yarn having been added both for heel reinforcement and to provide a visual identification of the heel area so that the stocking may be correctly fitted to the leg. The yarn 28 of each successive partial course is cut at opposite ends and is knit in tuck-float relationship with at least one stitch loop of an immediately adjacent course, to prevent pulling out of the cut ends of yarn, this being disclosed, for example in U.S. Pat. Nos. 3,241,340 and 3,603,116. Also, adjacent courses of elastomeric yarn 26 are separated in the convex heel pocket 15 by a partial course of yarn 28 forming less than a complete circumferential round of the stocking. The heel transition area 16, shown in FIGS. 1 and 3, is that area within which the cut ends of the partial courses terminate. Elastomeric yarn 26 is preferably present in greater amount in the rounds closely adjacent said pocket, as disclosed in U.S. Pat. No. 3,241,340.

As shown in FIG. 4, toe portion 36 is formed primarily of fine stretch non-elastomeric multifilament stretch or torque yarn, preferably doubled, in the range of 50 to 100 total doubled denier, providing a range of about 2.5 to 5.5 denier per filament. It should have a high crimp contraction like that of the boot, heel and instep non-elastomeric yarns. As a specific example, nylon torque yarn 23, such as 40/2 doubled nylon (80 denier) superloft yarn is knitted in every course of said portion but, unlike the knitted structure thereabove, is free from elastomeric stretchable retractive yarn, the line of demarcation therebetween appearing at 17 in FIG. 1. In the toe portion then, the stretch yarn 23 is relied upon primarily for coverage, when said toe portion is in a stretched condition around the corresponding part of the human foot. Toe portion 18 includes a shaped toe pocket 19 knit entirely of said non-elastomeric doubled nylon superloft yarn 28 which, in addition to nylon yarn 23, is in partial courses varying in length to provide a shaped, tapered toe pocket. The yarn 28 in each partial course is cut at opposite ends and is knit in tuck-float relationship with at least one stitch loop of an immediately adjacent course, to prevent pulling out of the cut ends of yarn, as with heel pocket 15. These partial courses vary in length, with the largest number being the shortest and terminating in area 42; the intermediate number being of intermediate length and terminating in area 44; and the smallest number being the longest and terminating in area 46.

Toe portion 18 terminates in a toe inspection opening adjacent shaped toe pocket 19 either above or below it, said toe inspection opening being defined by a welt 21, shown in detail in FIGS. 5 and 6, of doubled stretchable elastic fabric incorporating elastomeric stretchable retractive yarn 28, in addition to stretch yarn 23. The elastomeric yarn is knit in a 1:3 knit-float construction as in FIG. 5 and should be either a high stretch covered elastomer or bare spandex so as to form a very tight, controlled opening. One course of said welt has transferred stitches at 30 providing said doubled fabric welt with its looped end 32. A run resistant tab portion 34 is provided extending beyond said transferred stitches 30.

The above-described seamless therapeutic stocking is made on a continuously rotating cylinder knitting machine, specifically, the Zodiac 4F, manufactured by Billi S.p.a. Firenze Costruzione Macchine Tessili, of Italy, such machine being previously known and used in the U.S. and having been described in an English language training manual which has been available in the United States since at least as early as September, 1973.

Using this machine, with a 4-inch 401-needle cylinder and equipped with an elastomeric thread furnishing device, such as described in U.S. Pat. No. 3,209,558, knitting is begun at the top of the stocking in the usual manner with two knitting feeds, one of *s* twist non-elastomeric stretch 70/1 nylon torque yarn and the other of *z* twist non-elastomeric stretch 70/1 nylon torque yarn, and one inlay feed of elastomeric yarn such as 280 denier nylon covered spandex. The fourth available feeding station is not in use. The stitch size is controlled throughout the garment from the usual stitch control system incorporated in the machine and the elastomeric yarn is metered into the machine at a predetermined rate throughout the leg, instep, and foot portions. The fourth feed is activated in the heel pocket area to knit the partial courses 28 (FIG. 3) in area 15 (FIG. 1) including the terminal safety stitches in area 16 (FIG. 1), as shown in FIG. 3. The cam ring layout, FIGS. *7a* and *b*, shows a typical needle selecting system for a heel structure of this type. The cam segment AD in the needle butt race can be altered to permit completely independent movement of cam segments AD and AE to produce knitted tuck or float structures particularly at the terminal points of the partial courses used to form the heel pocket. Needle selection for each feed is accomplished in the usual manner from the pattern drums in the lower portion of the selector jacks or in the center section from the slide system acting on the selector jacks. The selection is transmitted to the intermediate jacks and from there to the needle butts. The heel portion is further rendered more desirable by the adaption of the fashioning of the instep area described in U.S. Pat. No. 3,443,404.

The partial courses of the heel area are eliminated in the foot section which is knitted in the same manner as the leg portion of the stocking with two knitting feeds and one inlay feed. A reinforcing yarn or an absorbent yarn can be provided in the foot area by using this yarn as extra courses or as superimposed or plated stocking sections under the foot area.

At this point (17 in FIG. 1) all of the elastomeric yarns are taken out of action and stretch nylon yarn such as 40/2 nylon superloft yarn introduced on all feeding stations. The toe pocket described can be knitted on 4, 6, 8 or even 12 feed hosiery machine provided they are equipped with special needle controls on all knitting feeds. On a 4-feed machine, one can knit with all feeds knitting over the toe area and with only one knitting feed under the foot or toe area. Three of the feeds knitting over the toe area produce partial courses while the one feed under the toe area produces knitted courses on all needles in the cylinder. Automatic trimming devices cut the loose ends of the partial courses to a prescribed length and by repeating this procedure for a number of rounds of the needle cylinder, a rounded toe pocket is formed on the knitting machine.

The toe fabric consists of three sections.

a. Ring Toe I — 4 feeds all nylon knitting on all needles (Area 36 of toe portion 18).
b. Toe Fashioning — 1 feed knits on all needles 360° = 401 needles
   1 feed knits on 205 needles terminating at area 46 (FIGS. 1 and 4).
   1 feed knits on 170 needles terminating at area 44 (FIGS. 1 and 4).
   1 feed knits on 134 needles terminating at area 42 (FIGS. 1 and 4).
c. Ring Toe II — 4 feeds all stretch nylon knitting on all needles (Area 38 of toe portion 18).

Figure 8A:
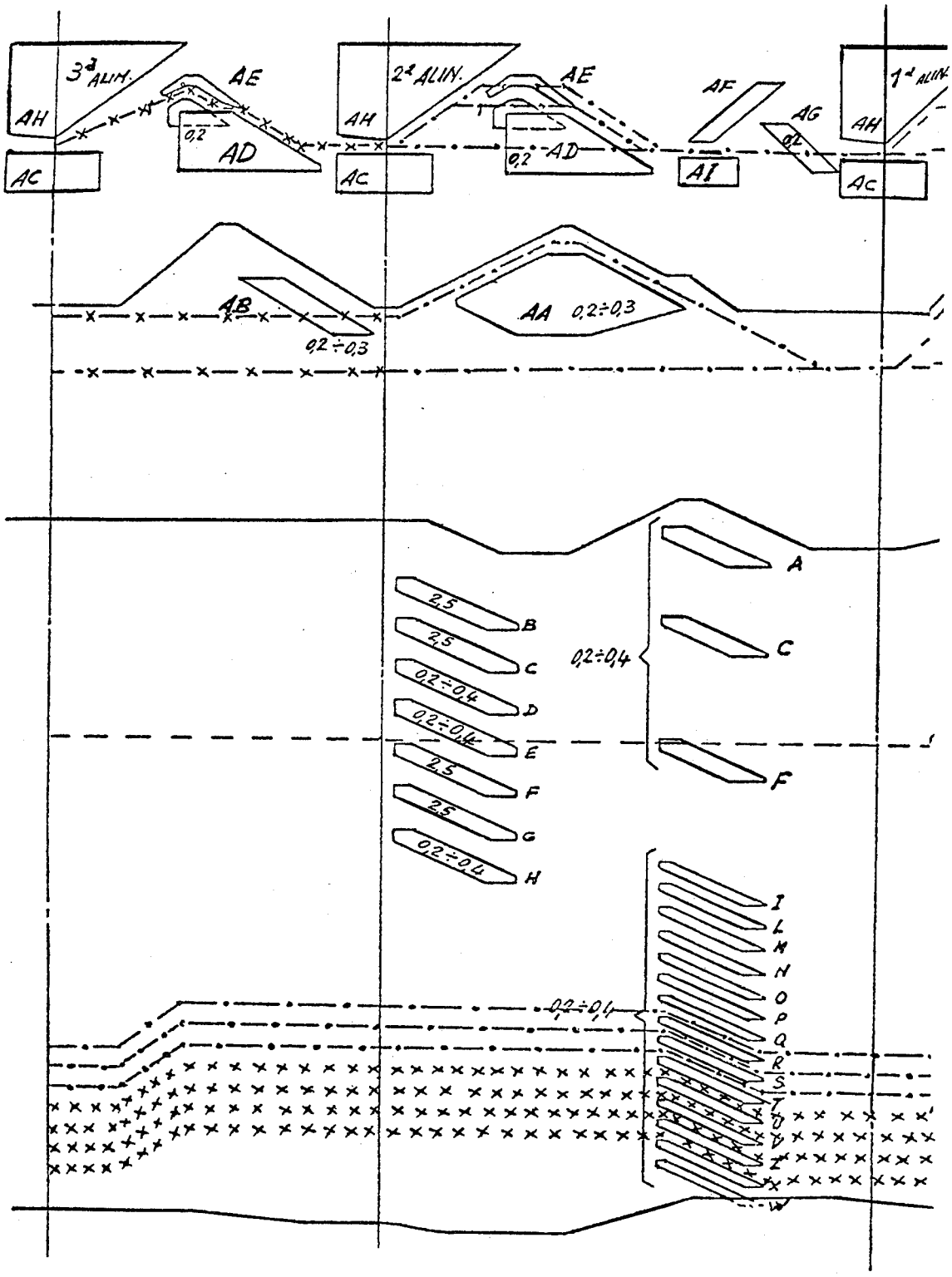
Figure 8B:
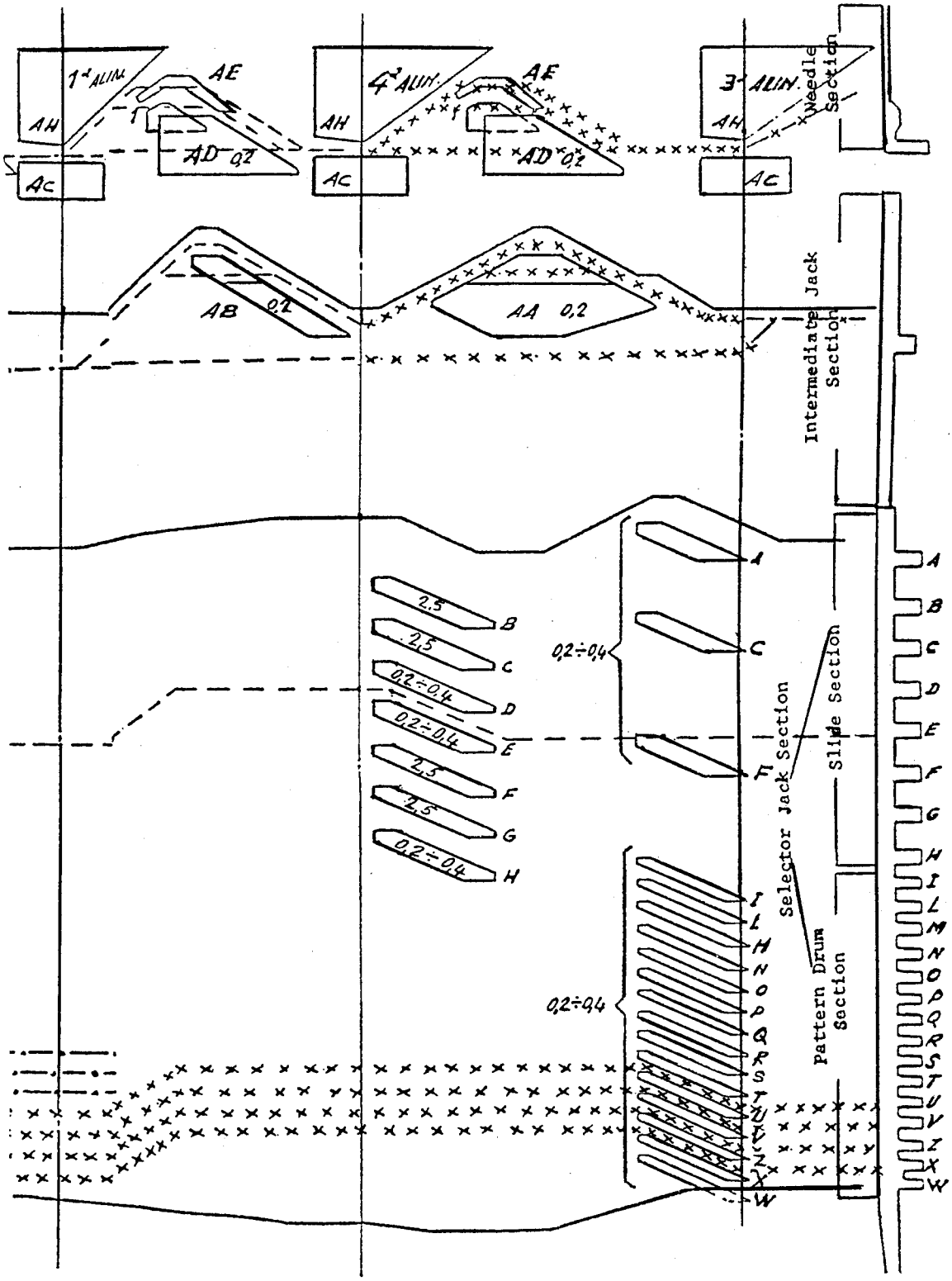

The needle movement of the toe pocket shown in the cam ring layout FIGS. 8*a* and *b* is as follows:

Feed number 3 knits on every needle each revolution of the cylinder while feeds number 1, 2 and 4 knit only partial courses on selected needle groups in the cylinder. These partial courses vary in length with the largest number being the shortest and terminating at area 42 and the smallest number being the longest and terminating at area 46 to provide a double tapered, shaped toe portion wherein the partial courses vary in length. Each partial course starts and ends with a series of tuck and float stitches (2 – 6) to lock the terminal ends of the partial courses into the fabric and avoid runs and failures when the garment is in use.

While it is feasible to introduce the partial courses on the same needles, it is generally preferred to introduce the partial courses at different needle groups in order to obtain a better, more wrinkle-free appearance of the toe pocket and avoid faulty trimmer action due to bunching of the terminal ends during the mechanical trimming operation.

The needle selection for the partial courses is initiated from slides R to X in the pattern drum control area and slide E in the slide control area.

Feed number 3 obtains its needle selection from cam segments AE and AD in the needle butt race. The needles in feed number 4 are activated from slides U to X in the pattern drum section of the selector jacks. The selection is transmitted to segment AA of the intermediate jack race. The segment AA is withdrawn slightly to produce one cam elevation at tuck height and another elevation at clear height. The cam segments AE and AD in the needle race are withdrawn on feeds number 1 and 4.

The needles in feed number 4 are activated from slides U to X in the pattern drum section of the selector jacks. The selection is transmitted to segment AA of the intermediate jack race. Segment AA is withdrawn slightly to elevate the needles in the main panel of partial courses to clear height and the needles in the terminal areas on both sides of the main panel to tuck height. The float needles between the tuck needles are not selected. Feed number 4 produces the shortest length of partial courses in the toe area 46.

The needles in feed number 1 are activated from slides U to X in the pattern drum section of the selector jacks as well as slide E in the selector jack slide section. The needle selection made in feed number 4 is transferred through intermediate jack cam segment AB which is partially withdrawn.

The needles selected by pattern drum slides U to X and the needles selected by selector slide E are raised to clear height by intermediate jack segment AB. Some of the needles in the terminal areas are raised to tuck height through the use of intermediate jacks with extra short butts. Non-selected jacks in the terminal area produce the float. Feed number 1 produces the intermediate length of partial courses in the toe area 44.

The needles in feed number 2 are activated from slides R to X of the pattern drum section of the selector jacks. This selection is transmitted to segment AA of the intermediate jack race. This segment has been altered and the selected intermediate jacks are raising the needles to clear height. Needle selecting segment AD is activated, but partially retracted, to provide the tuck stitches on long butt needles in the terminal areas of the partial courses and the non-selected needles between the tuck stitches produce the float stitches. Feed number 2 produces the largest area covered by the partial courses in the toe area 42.

In a 4-feed machine, the radius of the toe fabric depends on the number of extra courses chosen for the toe pocket. The ratio of courses is 4 above the toes and 1 below the toes while on 8-feed machines, the ratio could be 8 to 1. Functional automatic toe pockets can be formed with either system.

The ring toe (I & II) areas 36 and 38 represent approximately 24 courses and the shaped toe area therebetween about 50 revolutions of the cylinder. These ring toe areas, one being the area between welt 21 and the partial course area, are simple knit constructions at all four feeds. At this point, the machine is programmed to produce the elasticized toe welt section of the stocking. The final operation of the machine calls for knitting of an automatic elasticized welt including a makeup, transfer, and a number of anti-run courses.

The make-up and transfer are knitted in the usual manner by dividing the needles and producing a knit-float relationship between adjacent needle groups and placing the transfer bits in the position of the floating needles (odd needles). This deposits a knitting yarn on the transfer bits which is held until the welt fabric has been knitted. This make-up procedure is produced on one feed only and is in action for one complete cylinder revolution. The remaining three feeds knit on all needles.

The transfer is produced in a similar manner after the welt fabric has been knitted. The needles are divided again but this time the odd needles are raised to knitting position while the even needles are left in float positions. On the rise to knitting position, the odd needles advance through the openings provided in the transfer bits and take the loops deposited on the bits during the make-up operation.

The make-up and transfer operations are conventional.

Figure 9A:
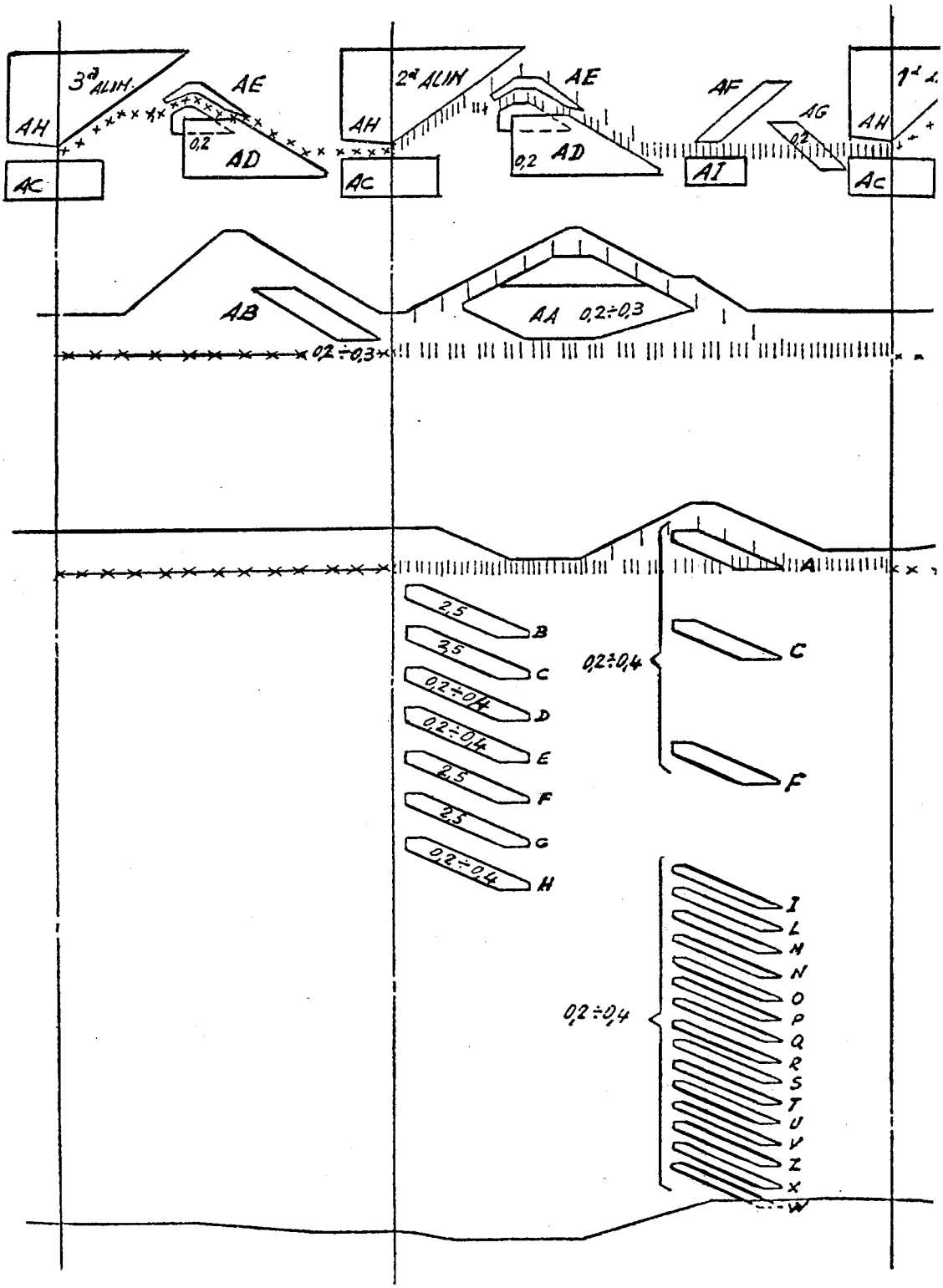
Figure 9B:
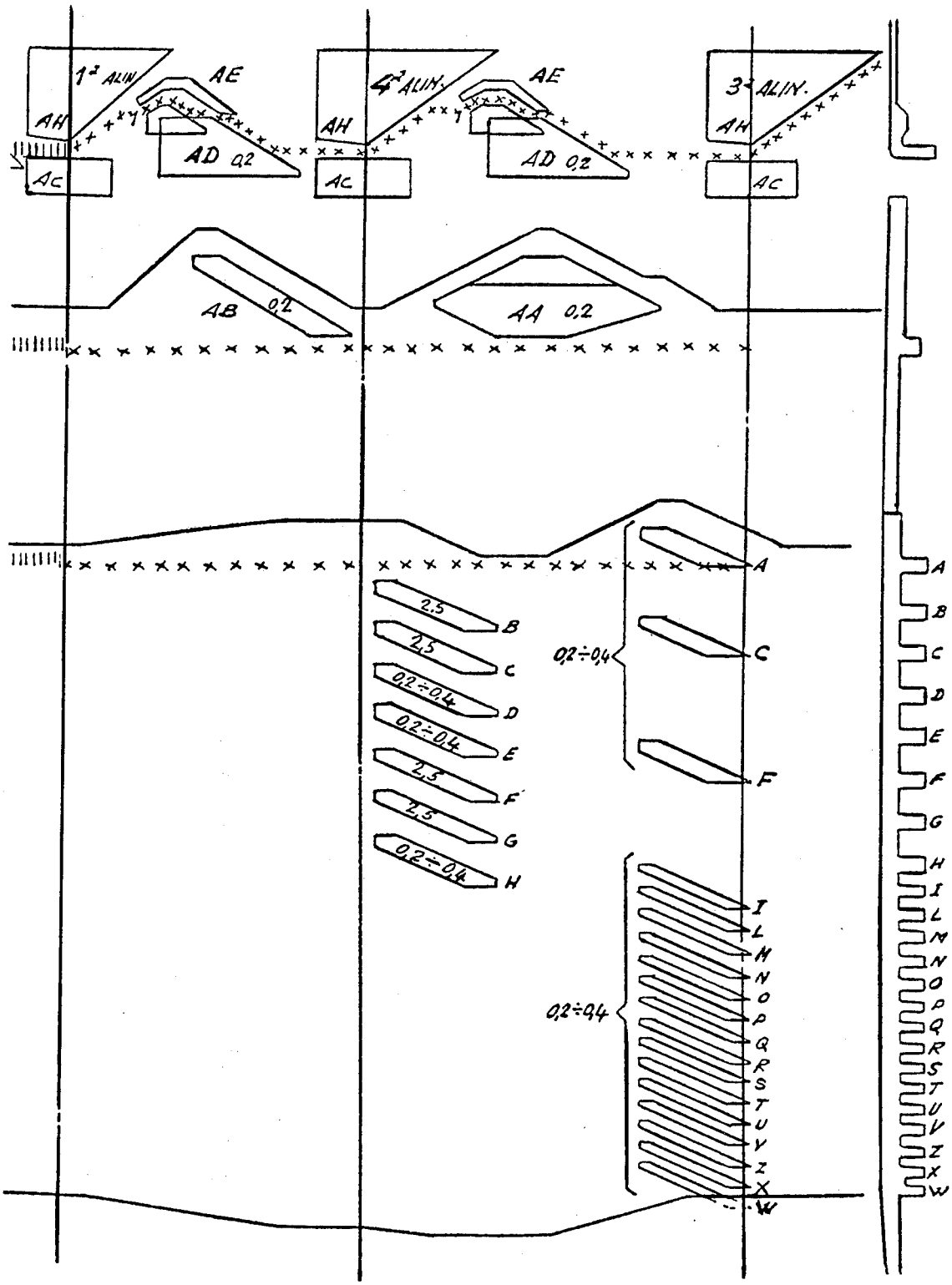

The elasticized welt fabric knitted between the make-up and transfer operations differs slightly from previous descriptions, its cam ring layout being shown in FIGS. 9*a* and *b*. The welt fabric shown in FIG. 5 is knitted on four feeds with one of the feeds containing, in addition to the conventional knitting yarn, an elastic yarn incorporated in the fabric in a 1:3 knit-and-float selection.

The run-resistant welt tab 34 after the transfer can be knitted in various ways. I have found that the procedure using three feeds produces the best results.

Feed No. 1: All needles knitting

Feed No. 2: Two yarns fed on alternating needles Knit-tuck with nylon (odd) and knit-float with bare spandex (odd)

Feed No. 3: All needles knitting

Feed No. 4: Tuck-knit on alternating needles (even) so that those needles knitting on Feed No. 2 are tucking on Feed No. 4.

The degree of run resistance is affected materially by the stitch size drawn on each feed as well as the stitch type chosen. A run-resistant tab knitted with a density to produce about 9 inches of total stretch performs very well in this toe tab.

The stocking of the invention as it is produced by the knitting machine is shown in phantom lines in FIG. 1. During the boarding process which follows, the toe portion is pulled around the end of the board to position the toe inspection opening under the foot. The boarding process sets the yarns in that position to produce the finished stocking shown in solid lines in FIG. 1.

While the inspection toe opening has been shown to be located under the foot, it can obviously be placed above the base of the toes.

Although the usual procedure calls for the knitting of the stocking from the thigh to the toe, it is equally appropriate to start the stocking at the automatic inspection toe opening and knit from toe to thigh. In this case, a run-resistant toe tab prior to the elastic welt becomes unnecessary, but the machine will have to be modified to knit with a higher stitch density at the beginning of the stocking, the ankle and foot area, and a lower stitch density in the thigh area. The final courses in the upper thigh area should contain several courses of an anti-ravel yarn or anti-ravel stitch formations to permit the usual processing.

What is claimed is:

1. A tubular knit seamless stocking having a boot portion, a heel portion, an instep portion and a toe portion said boot, heel and instep portions being formed primarily of fine stretch non-elastomeric multifilament torque yarn having a denier within the range of about 50 to 100 and of 2.5 to 5.5 denier per filament, with a crimp contraction of at least about 46 percent, knitted in every course of said portions and incorporating substantially throughout said boot and instep portions at least one elastomeric stretchable retractive yarn having the major portion thereof inlaid coursewise of, and locked in, said knitted boot and instep portions at frequent intervals in every course in which it occurs said toe portion being formed primarily of said non-elastomeric yarn free from elastomeric stretchable retractive yarn and said heel and toe portions each including a shaped pocket knit of said non-elastomeric yarn including partial courses, the yarn of each partial course being cut at opposite ends, and the yarn of each partial course being knit in tuck-float relationship at its terminal ends with at least one stitch loop of an immediately adjacent course to prevent pulling out of the cut ends of yarn.

2. A tubular knit seamless stocking having a boot portion, a heel portion, an instep portion and a toe portion said boot, heel and instep portions being formed primarily of fine stretch non-elastomeric multifilament torque yarns of *s* and *z* twist having a denier within the range of about 50 to 100 and 2.5 to 5.5 denier per filament with a crimp contraction of at least about 46 percent, said *s* and *z* non-elastomeric yarns being alternately knitted in every course of said portions and incorporating substantially throughout said boot, heel and instep portions at least one elastomeric stretchable retractive yarn havin a denier of about 210 to 390 with the major portion thereof inlaid coursewise of, and locked in, said knitted boot and instep portions at frequent intervals in every course in which it occurs said heel portion including a shaped heel pocket knit of said non-elastomeric yarn including partial courses, the yarn of each partial course being cut at opposite ends, and the yarn of each partial course being in tuck-float relationship at its terminal ends with at least one stitch loop of an immediately adjacent course to prevent pulling out of the cut ends of yarn said toe portion being formed primarily of fine stretch non-elastomeric multifilament torque yarn having a total denier within the range of about 50 to 100 and of 2.5 to 5.5 denier per filament, with a crimp contraction of at least about 46 percent, knitted in every course of said portion and free from elastomeric stretchable retractive yarn said toe portion including a shaped toe pocket knit of said non-elastomeric yarn including partial courses, the yarn in each partial course being cut at opposite ends, and the yarn of each partial course being knit in tuck-float relationship at its terminal ends with at least one stitch loop of an immediately adjacent course to prevent pulling out of the cut ends of yarn.

3. A tubular knit seamless stocking having a boot portions a heel portion, an instep portion and a toe portion said boot, heel and instep portions being formed primarily of fine stretch non-elastomeric multifilament torque yarns of *s* and *z* twist, said non-elastomeric multifilament yarns having a denier within the range of about 50 to 100 and of 2.5 to 5.5 denier per filament with a crimp contraction of at least about 46 percent, said *s* and *z* non-elastomeric yarns being alternately knitted in every course of said portion and incorporating substantially throughout said boot, heel and instep portions at least one elastomeric stretchable retractive yarn having a denier within the range of about 210 to 390 and having the major portion thereof inlaid coursewise of, and locked in, said knitted boot, heel and instep portions at frequent intervals in every course in which it occurs said heel portion including a shaped heel pocket knit of said non-elastomeric boot, heel and instep portion yarn including partial courses, the yarn of each partial course being cut at opposite ends, and the yarn of each partial course being knit in tuck-float relationship with at least one stitch loop of an immediately adjacent course to prevent pulling out of the cut ends of yarn said toe portion being formed primarily of fine stretch non-elastomeric multifilament doubled torque yarn having a total doubled denier within the range of about 50 to 100 and of 2.5 to 5.5 denier per filament, with a crimp contraction of at least about 46 percent, said toe portion being free from elastomeric stretchable retractive yarn said toe portion including a shaped toe pocket knit of said non-elastomeric toe portion yarn including partial courses varying in length providing a tapered toe pocket, the yarn in each partial course being cut at opposite ends, and the yarn of each partial course being knit in tuck-float relationship with at least one stitch loop of an immediately adjacent course to prevent pulling out of the cut ends of yarn said toe portion including a toe inspection opening adjacent said shaped toe pocket, said toe inspection opening including a welt of doubled stretchable elastic fabric incorporating elastomeric stretchable retractive yarn, at least one course of said welt having transferred stitches providing said doubled fabric welt, and a run resistant tab portion extending beyond said transferred stitches.

4. A tubular knit seamless stocking having a toe portion including a shaped toe pocket knit including partial courses varying in length providing a tapered toe pocket, the yarn in each partial course being cut at opposite ends, and the yarn of each partial course being knit in tuck-float relationship with at least one stitch loop of an immediately adjacent course to prevent pulling out of the cut ends of yarn said toe portion being formed primarily of fine stretch non-elastomeric multifilament torque yarn having a denier within the range of about 50 to 100 and of 2.5 to 5.5 denier per filament, with a crimp contraction of at least about 46 percent, and being free from elastomeric stretchable retractive yarn said toe portion including a toe inspection opening adjacent said shaped toe pocket, said toe inspection opening including a welt of doubled stretchable elastic fabric incorporating elastomeric stretchable retractive yarn, at least one course of said welt having transferred stitches providing said doubled fabric welt.

5. A stocking as claimed in claim 4, wherein, said non-elastomeric yarn is a doubled yarn.

6. A tubular knit seamless stocking having a toe portion said toe portion being formed primarily of fine stretch doubled non-elastomeric multifilament torque yarn having a total doubled denier within the range of about 50 to 100 and of 2.5 to 5.5 denier per filament with a crimp contraction of at least about 46 percent said toe portion being free from elastomeric stretchable retractive yarn said toe portion including a shaped toe pocket knit of non-elastomeric yarn including partial courses providing a tapered toe pocket, the yarn in each partial course being cut at opposite ends, and the yarn of each partial course being knit in tuck-float relationship at its terminal ends with at least one stitch loop of an immediately adjacent course to prevent pulling out of the cut ends of yarn and said toe portion including a toe inspection opening adjacent said shaped toe pocket.

7. A tubular knit seamless stocking having a toe portion said toe portion being formed primarily of fine stretch doubled non-elastomeric multifilament torque yarn having a total doubled denier within the range of about 50 to 100 and of 2.5 to 5.5 denier per filament, with a crimp contraction of at least about 46 percent, said toe portion being free from elastomeric stretchable retractive yarn said toe portion including a shaped toe pocket knit of non-elastomeric yarn including partial courses varying in length providing a tapered toe pocket, the yarn in each partial course being cut at opposite ends, and the yarn of each partial course being knit in tuck-float relationship with at least one stitch loop of an immediately adjacent course to prevent pulling out of the cut ends of yarn and said toe portion including a toe inspection opening adjacent said shaped toe pocket said toe inspection opening including a welt of doubled stretchable elastic fabric incorporating elastomeric stretchable retractive yarn, at least one course of said welt having transferred stitches providing said doubled fabric welt, and a run resistant tab portion extending beyond said transferred stitches.

* * * * *